US006241411B1

(12) United States Patent
Brieva et al.

(10) Patent No.: US 6,241,411 B1
(45) Date of Patent: Jun. 5, 2001

(54) MASCARA BRUSH, CONTAINER, AND METHOD

(75) Inventors: Hernando Brieva, Manalapan; Debra Marsha DiGirolamo, Holmdel, both of NJ (US); Erlinda Dugaduga Leone, Chestnut Ridge, NY (US); Tian Xiang Wang, Edison, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 09/294,107

(22) Filed: Apr. 19, 1999

(51) Int. Cl.[7] ..... A46B 11/00

(52) U.S. Cl. ..... 401/129; 132/200; 132/218; 300/21

(58) Field of Search ..... 401/129, 121, 401/268; 132/200, 218, 320; 300/21; 15/206

(56) References Cited

U.S. PATENT DOCUMENTS 5,761,760 * 6/1998 Dumler ..... 15/206

* cited by examiner

*Primary Examiner*—Gregory L. Huson
*Assistant Examiner*—Peter deVore
(74) *Attorney, Agent, or Firm*—Julie Blackburn

(57) ABSTRACT

A brush for the application of mascara to the eyelashes comprised of a central core of twisted metal wire, having gripped therebetween split fibers which extend radially from the core, wherein the fibers are split at least a portion of the distance from the fiber tip to the central core; and method for making the brush; and a mascara component containing the brush.

3 Claims, 2 Drawing Sheets

MASCARA BRUSH, CONTAINER, AND METHOD

TECHNICAL FIELD

The invention is in the field of brushes for application of mascara to the eyelashes, mascara applications systems, and a method.

BACKGROUND OF THE INVENTION

Mascara both lengthens and thickens lashes. In order to obtain optimal results, ideally each lash should be liberally and uniformly coated with mascara, and the lashes should not clump together. In general, the more thickly mascara is applied, the greater the tendency is for the lashes to clump together. Brushes which are designed to provide thick application of mascara often have bristles spaced so closely together that the lashes cannot penetrate the bristle face to exert a combing effect on the lashes as the mascara is applied. This contributes to clumping. On the other hand, brushes with fewer bristles permit eyelashes to pass through the bristle face as mascara is applied, and thereby exert a combing effect. However, due to the reduced bristle density on such brushes, they are often not capable of thickly coating mascara onto the eyelashes because there are fewer bristles onto which mascara is loaded. A number of patents exist that address different ways of improving the application of mascara onto eyelashes while minimizing difficulties such as lash clumping and uneven distribution.

U.S. Pat. No. 5,063,947 teaches mascara brushes made from a variety of filaments, which are then subjected to rotary grinding which causes the fiber ends to become "shredded". The patentee claims that the shredded fiber ends provide hooks, which are additional reservoirs for mascara. Then, when the brush is used to apply mascara to the lashes, the additional mascara in the reservoirs will be applied to the lash also causing heavier application. While the additional reservoirs provided by the hooks may theoretically hold additional mascara, it has been found that the mascara does not readily release from such reservoirs when the brush is stroked against the lashes. In addition, shredded ends, or hooks, provide safety issues in that they could cause eye damage if accidentally poked into the eye, particularly if the fiber used to make the brush has a larger, hence stiffer, cross-section.

U.S. Pat. No. 4,927,281 teaches mascara brushes made from fibers which have capillary channels. The patentee claims that the capillary channels provide additional reservoirs for mascara. When the brush is dipped into the mascara, it fills the reservoirs. When the brush is stroked against the lashes, the mascara in the reservoirs is alleged to deposit onto the lashes. While the theory behind such a brush design is good, as a practical matter the mascara tends to become lodged into the channels, and does not release the desired bigger load of mascara to the lashes.

A variety of other patents deal with mascara brush designs that allegedly provide better application of mascara to the lashes without the drawback of lash clumping or uneven distribution. However, none of the current brush designs is optimal for this purpose.

The object of the invention is to provide a mascara brush which is capable of applying a liberal coat of mascara to the eyelashes, yet with reduced clumping of the lashes and uneven distribution of product.

The object of the invention is to provide a mascara brush made of split fibers which provide excellent combing and application of mascara to the lashes.

The object of the invention is to provide a mascara brush made of split fibers which do not contain shredded ends or hooks.

The object of the invention is to provide a mascara brush made from larger cross-section fibers which are capable of providing a combing effect to lashes, yet do not pose a safety hazard.

The object of the invention is to provide a method for making a mascara brush having split fibers.

SUMMARY OF THE INVENTION

The invention is directed to a brush for the application of mascara to the eyelashes comprised of a central core of twisted metal wire, having gripped therebetween split fibers which extend radially from the core, wherein the fibers are split at least a portion of the distance from the fiber tip to the central core.

The invention is also directed to a method for making a mascara brush having split fibers comprising the steps of:

a) preparing a brush comprised of a central core of twisted metal wires, having gripped therebetween splittable fibers having at least one stress point, which extends radially from the core, b) splitting the fibers in the brush by subjecting the brush to a device which applies pressure to the fiber, causing the stress point of the fiber to break, thereby causing splitting.

The invention is also directed to a mascara application system comprising, in combination;

a) a reservoir for mascara containing one opening, b) a closure for said reservoir, said closure having and inner surface and an outer surface, c) a wand having a proximal end comprised of a stem which is affixed to the inner surface of said closure and a distal end having affixed thereto a brush comprised of twisted metal wire having gripped therebetween split fibers which extend radially from the core, wherein the fibers are split at least a portion of the distance from the fiber tip to the central core.

DETAILED DESCRIPTION

Figure 1:
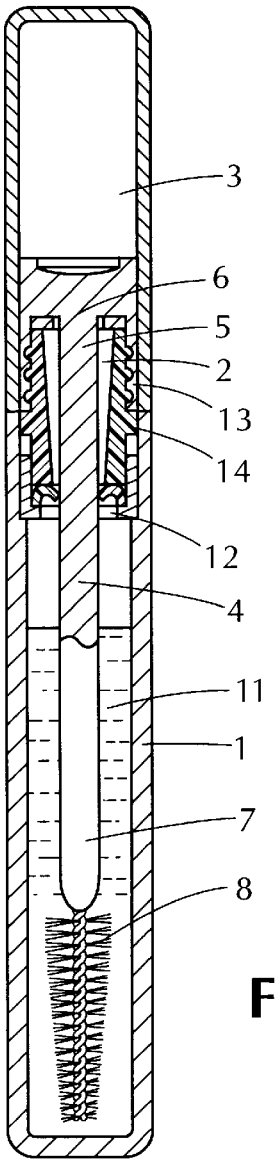
FIG. 1: is a cross-sectional view of the mascara brush and container in accordance with the invention.
Figure 3:
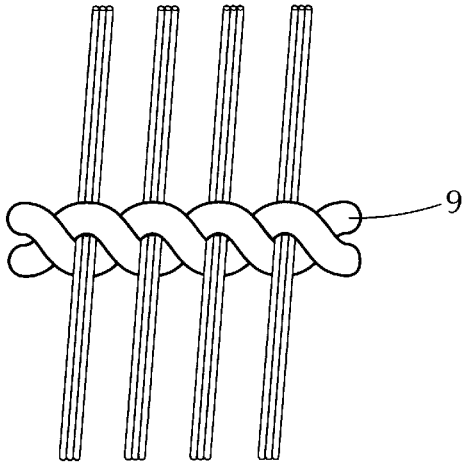
FIG. 3: is a close up illustration of the two twisted metal wire brush and splittable fibers gripped between the wires, prior to splitting.

FIG. 1 shows a cross-sectional view of the mascara container and brush of the invention. Typically, the container comprises a reservoir for mascara 1 containing one opening 2. There is a closure 3 for the reservoir for mascara 1. Attached to the closure 3 is a wand 4. The proximal end 5 of the wand 4 is attached to the inner surface 6 of the closure 3. The distal end 7 of the wand 4 has affixed thereto a brush 8 comprised of twisted metal wire 9 having gripped therebetween split fibers 10. When the closure 3 is attached to the reservoir for mascara 1 so that the container is in the closed position, the brush 8 is immersed in the mascara 11. Generally, the reservoir for mascara 1 contains a wiper 12 which is is formed from a synthetic thermoplastic material that has memory, i.e. is capable of flexure to permit removal of the brush and which returns to its original size and shape, and has a diameter slightly less than that of the brush 8 such that when the brush 8, is pulled through the wiper 12, excess mascara is removed from the brush. Typically, the closure 3 is affixed to the reservoir for mascara 1 by mating screw threads 13 on the closure 3 with similarly sized and shaped screw threads on the neck of the reservoir 14 thereby forming an air tight seal.

Figure 2:
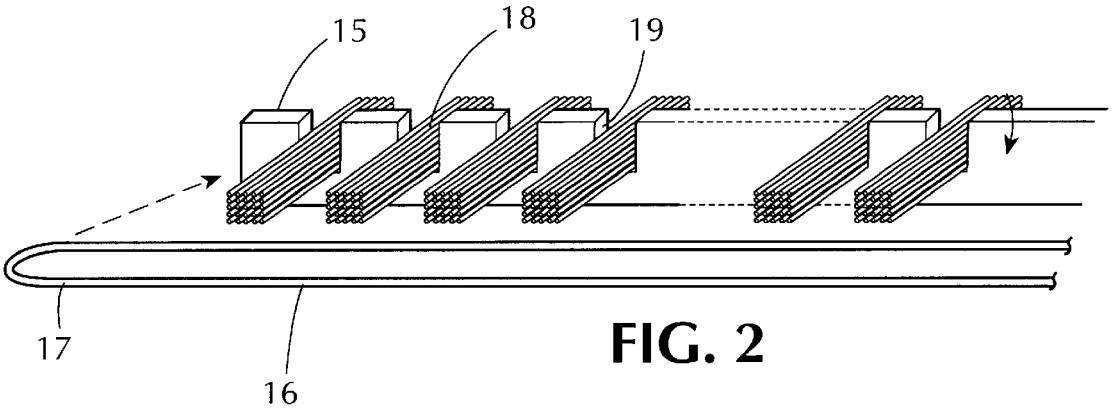
FIG. 2: is an illustration of one intermediate step in the manufacture of mascara brushes in general.

The mascara brush 8 is made using traditional machinery known in the art for this purpose. One type of machine that may be used to make such brushes is a Zahoransky MA1, made by Zahoransky GmbH in Todtnau Germany. The cut fibers used to make the brush are purchased in small containers called pucks which contain the fiber in unsplit form 18. The unsplit fibers 18 in the puck are loaded into a retaining device in the machine called a magazine (not shown), which has a floor that slides back and forth (not shown) to permit the unsplit fibers 18 to fall from the magazine into a device referred to as a rake 15 as depicted in FIG. 2. The rake 15 contains depressions 19 into which the unsplit fibers 18 fall. The machine bends a metal wire 16 into a bobby pin or U-shape 17. The fibers 18 in the rake 15 are then slipped between the arms of the U-shaped metal wire 17. The two ends of the wires are gripped by the machine, and the wires are twisted to form the brush. Another type of machine that may be used to make the brush is a Zahoransky MA100 which operates in essentially the same fashion except that the unsplit fibers are purchased on spools having a certain number of fibers per spool. The spooled fibers are fed into the machine and positioned between the U-shaped wire, then cut. The ends of the U-shaped wire are then twisted in the same manner to yield a brush. The brush is then trimmed to the desired shape and is ready for affixing to the wand 4.

Figure 4:
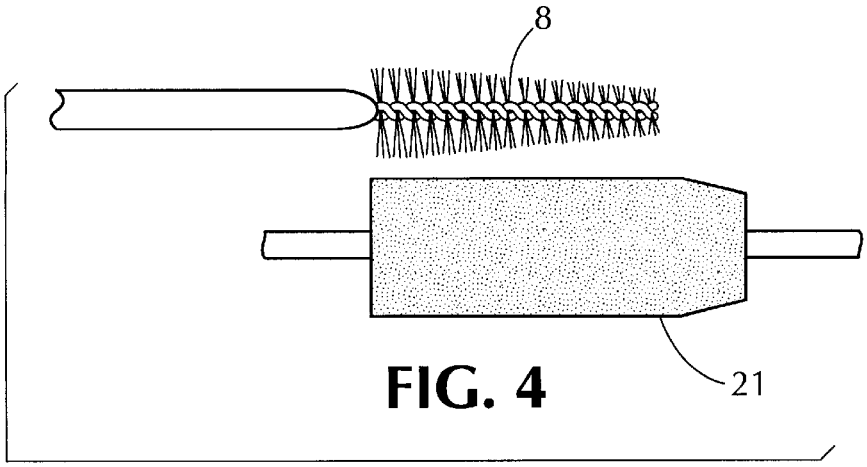
FIG. 4: is an illustration of one way in which the fibers may be split; by contact with a rotary grinding wheel.
Figure 5:
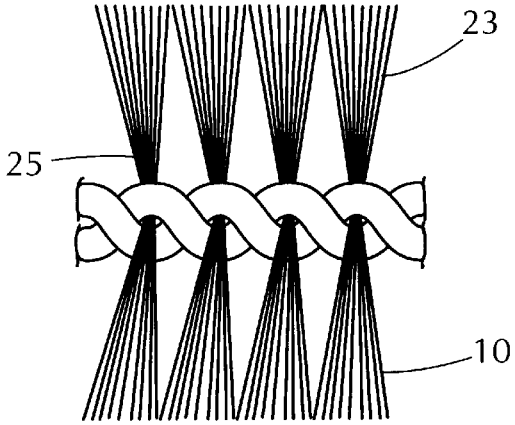
FIG. 5: is an illustration of the brush of FIG. 3 after the fibers have been split from the fiber tip to the core.
Figure 6:
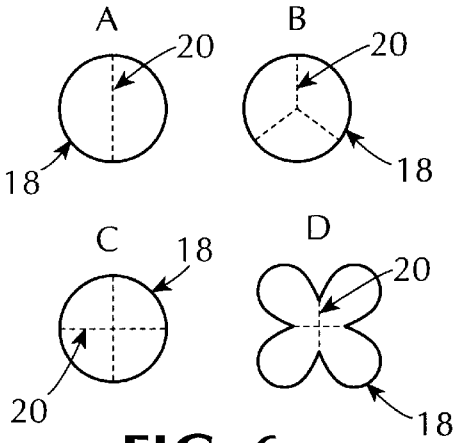
FIGS. 6A,B, C, and D: illustrate fiber cross-sections suitable for use in the brush of the invention, where the stress points are shown by broken lines.
Figure 7:
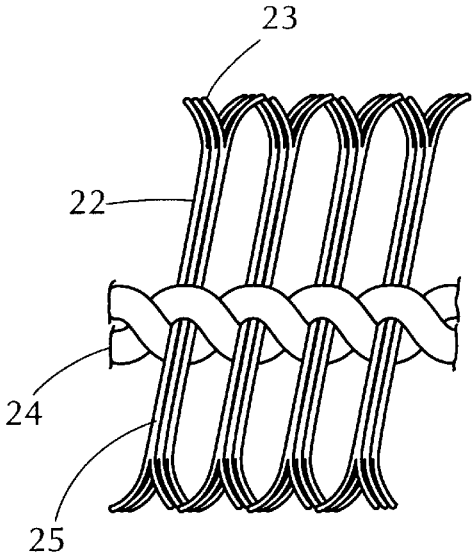
FIG. 7: illustrates a second embodiment of the invention showing the brush of FIG. 3 after the fibers have been split partway from the fiber tip to the core.

The mascara brush 8 of the invention is made from fibers which are "splittable", i.e. which contain stress weld points such that when the brush fibers are subjected to pressure the fibers will split at the stress points. FIGS. 6A–D illustrate the cross-section of certain splittable fibers where the broken lines illustrate stress points 20 at which the fiber will split when subjected to pressure. The splittable fibers 18 may be made from any synthetic material such as nylon, polyester, polytetrafluoroethylene, or a similar synthetic material. Preferably, the fibers are made from nylon 6/10, 6/12 and the like. The cross-sectional diameter of the splittable fibers may vary from 0.002 to 0.015 inch, preferably 0.003 to 0.0013 inch. In general, the diameter of the fiber tends to be larger prior to splitting to enable fracture into smaller fragments. Splittable fibers are general manufactured by methods known in the art, such as extruding a plurality of synthetic filaments from an extrusion device and causing the synthetic filaments to become bonded together, the bonding or weld points being where the fiber will split upon application of pressure. In the preferred embodiment of the invention, after the mascara brush 8 is made, it is subjected to rotary grinding as depicted in FIG. 4, wherein the brush 8 is held next to a rotary grinder 21, which is powered to move in one direction. The rapid movement of the grinder 21 exerts pressure on the stress points 20 of the fibers 18 and causes them to split along the stress points 20. The amount of splitting depends on the amount of time the brush 8 is held against the grinder 21 as well as the amount of pressure which is applied. Preferably, the rotary grinder 21 is operated in only one direction, i.e. clockwise or counterclockwise. It may be desired to split the fibers 18 only partway 22 from the fiber tip 23 to the twisted metal wire core 24 as illustrated in FIG. 7, or the entire way from the fiber tip 23 to the fiber base 25. The degree to which the fiber 18 is split, depends on the amount of pressure applied by the grinder 21 and the time the brush 8 is exposed to the grinder 21. For example, the fiber may be split only one fourth of the distance between the fiber base and the fiber tip, or one third, or two thirds, three fourths, etc., depending on the effects desired. It may be desired to have some fibers split the entire distance from the fiber tip to the twisted metal wire core, with the other fibers split only one half the distance from the fiber tip to the wire core. In the latter type of brush, the partially split fibers will provide a more rigid fiber which serves well to comb the lashes. The brush 8 of the invention may comprise a mixture of split and unsplit fibers or may comprise a mixture of split fibers and other fiber types such as quadralobal, hollow, sinusoidal and the like.

The fibers 18 of the brush 8 may also be split by exposure to other devices which exert pressure such as high pressure water jets, a rotating wire brush, and other type of device which is capable of applying sufficient pressure to cause the fibers to split along the stress weld points.

The wire 16 used to make the brush 8 generally has a diameter from 0.015 to 0.033, preferably 0.020 to 0.030 inch. The brush 8 may have a fiber density ranging from about 25 to 500 fibers per ¼ inch of brush length, preferably 25 to 300 fibers per ¼ inch brush length. Most preferred is where the brush has a fiber density of about 20–60 fibers per ¼ inch of brush length, i.e. so that in a brush having a length of 1 inch, there would be about 80 to 240 total fibers. Preferred splittable fibers are tetralocular (4 stress points) or trilocular (3 stress points), having a fiber diameter of about 0.011 inch, which are available from DuPont.

The mascara brushes made according to the invention provide better application of mascara and improved combing of the lashes. The result is more thickly applied mascara with no clumping.

We claim:

1. A method for making a mascara brush having split fibers comprising the steps of:

a) making a twisted metal wire brush using splittable fibers containing stress weld points, b) subjecting the brush to a splitting means which exerts mechanical pressure on the fibers thereby causing the fibers to split at the stress weld points for least a portion of the distance from the fiber tip to the brush core.

2. The method of claim 1 wherein the splitting means is a rotary grinding wheel.

3. The method of claim 2 wherein the brush is subjected to the rotary grinding wheel in only one direction.

* * * * *